US005184788A

United States Patent [19]

Schenk et al.

[11] Patent Number: 5,184,788

[45] Date of Patent: Feb. 9, 1993

[54] APPARATUS FOR GUIDING AND MORE PARTICULARLY COILING WEBS OF MATERIAL

[75] Inventors: Horst Schenk, Dortmund; Herbert Gellenbeck, Hemer, both of Fed. Rep. of Germany

[73] Assignee: Sundwiger Eisenhutte Maschinenfabrik Grah & Co., Hemer-Sundwig, Fed. Rep. of Germany

[21] Appl. No.: 644,172

[22] Filed: Jan. 22, 1991

[30] Foreign Application Priority Data

Feb. 2, 1990 [DE] Fed. Rep. of Germany ..... 4003067

[51] Int. Cl.[5] ..... B65H 18/00; B65H 20/00

[52] U.S. Cl. ..... 242/66; 242/78.1; 242/67.1 R; 226/182; 226/186; 226/190

[58] Field of Search ..... 242/66, 67.1 R, 67.2, 242/DIG. 3, 78.1, 78.3; 226/176, 182, 186, 190, 191, 193

[56] References Cited

U.S. PATENT DOCUMENTS

| | | | |
|---|---|---|---|
| 1,882,219 | 10/1932 | Harwood et al. | 242/66 |
| 2,573,188 | 10/1957 | Dyker | 242/66 |
| 3,022,929 | 2/1962 | Myers et al. | 226/193 X |
| 3,250,484 | 5/1966 | Fair | 242/66 |
| 3,395,870 | 8/1968 | Klinger | 242/67.1 R X |
| 3,659,643 | 8/1970 | Pauels | 164/276 |
| 3,850,381 | 11/1974 | Moore | 242/66 |
| 4,063,440 | 12/1977 | Brashear | 242/78.1 X |
| 4,247,058 | 1/1981 | Eddy | 226/118 X |
| 4,380,164 | 4/1983 | Kuwano | 242/78.1 X |
| 4,494,706 | 1/1985 | Becherer et al. | 242/67.1 R X |
| 4,688,737 | 8/1987 | Kogane et al. | 242/67.1 R |
| 4,706,586 | 11/1987 | Vogt et al. | 242/66 X |
| 4,830,808 | 5/1989 | Bichot et al. | 252/66 X |
| 4,964,583 | 10/1990 | Vukumoto et al. | 226/97 X |

FOREIGN PATENT DOCUMENTS

| | | | |
|---|---|---|---|
| 0115026 | 12/1983 | European Pat. Off. . | |
| 0325306 | 7/1987 | European Pat. Off. . | |
| 3708891 | 3/1987 | Fed. Rep. of Germany . | |
| 45-25876 | 8/1970 | Japan | 242/66 |
| 2058721 | 4/1981 | United Kingdom | 242/66 |

*Primary Examiner*—Daniel P. Stodola
*Assistant Examiner*—John P. Darling
*Attorney, Agent, or Firm*—Sprung Horn Kramer & Woods

[57] ABSTRACT

An apparatus for coiling webs of material, more particularly webs of material (5) arriving from a ribbon casting machine, and for coiling the webs of material (5) if necessary. For the purposes of guiding and coiling, brush rollers (20, 21, 23–26) are used consisting of axially spaced-out annular disc-shaped brush elements between which guide elements (27) extending in the direction in which the ribbon runs are disposed, which prevent the web of material (5) of low rigidity from becoming wound around a brush roller (20, 21, 23–26).

10 Claims, 5 Drawing Sheets

APPARATUS FOR GUIDING AND MORE PARTICULARLY COILING WEBS OF MATERIAL

Figure 1:
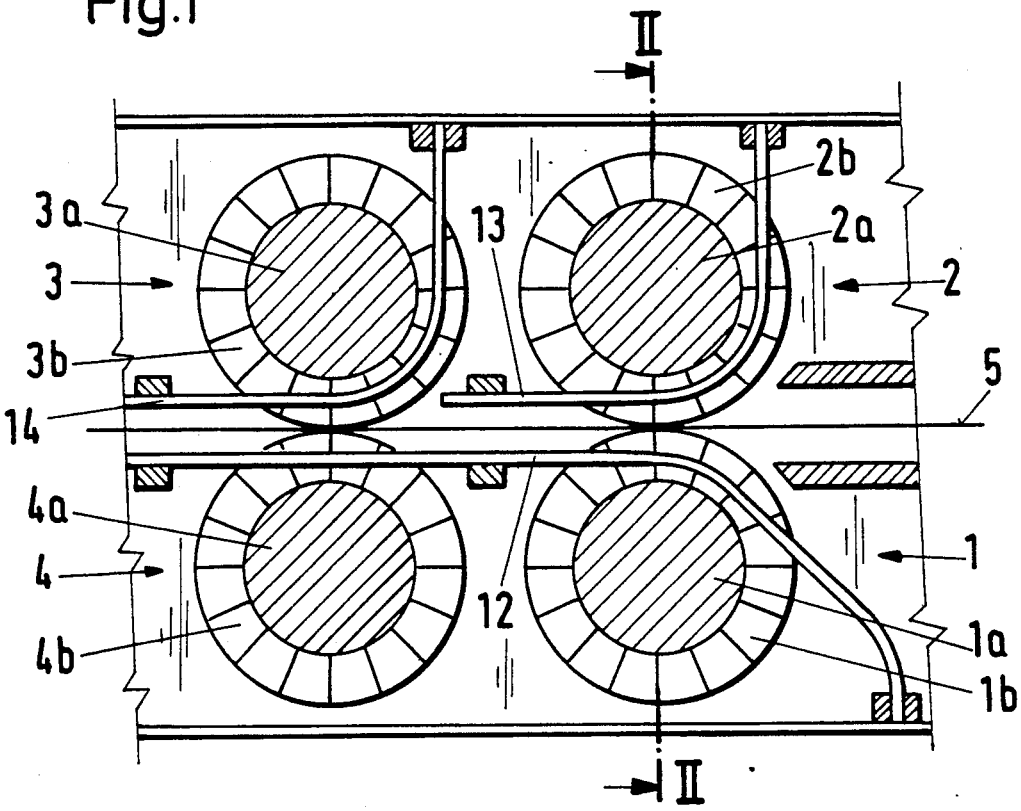

The invention relates to an apparatus for guiding and more particularly coiling webs of material, more particularly webs of material arriving from a ribbon casting machine, comprising at least one brush roller and one further roller forcing the web of material against the brush roller.

Apparatuses of the kind specified are known. They are used to intercept the web of material arriving from a casting wheel to feed the material to a coiling device. To enable that problem to be satisfactorily solved, as a rule the brush roller runs at a higher rotational speed than the wheel of the ribbon casting machine feeding the web of material to the brush roller. The object of the differential speed is to pull the web of material tight. Slip equalization takes place at the brush roller, without the web of material being damaged thereby. One difficulty in such apparatuses is that the start of the web of material becomes wound around the brush roller if the web consists of a very thin material. Another disadvantage is that using the apparatus the web of material can be connected to the coiling device not via the start of the web, but via a portion thereof lying further to the rear. Generally the cut-off portion lying upstream thereof is lost. If only small quantities are to be cast, the percentage of loss is high (German Patent Specification 37 08 891 C1; European Patent Specification 0 021 049 B1; European Patent Specification 0 316 949 A2).

It is an object of the invention to provide an apparatus for guiding webs of material in sheet thickness arriving from a casting wheel of a ribbon casting machine, by means of which the web of material arriving from upstream systems can be smoothly conveyed at very different speeds up to, for example, 50 meters per second, and if necessary coiled.

This problem is solved according to the invention by the feature that the brush roller is equipped with a plurality of axially spaced-out annular disc-shaped brush elements between which there extend stationary guide elements of a guide cage which extend in the direction in which the web of material runs.

Due to its being equipped with brush elements, the apparatus according to the invention adapts itself with slip formation to the given conveying speed of the web of material. There are no difficulties with the start of ribbons, since the guide elements of the guide cage ensure that the web of material remains substantially in the given plane of guidance and does not become wound around a brush roller. Preferably the further roller also takes the form of a brush roller. Independently of the construction of the further roller, according to the invention stationary guide elements of the guide cage are associated with the further roller also. If the further roller is constructed in the form of a brush roller, they are also constructed according to the invention in the form of rods.

The web of material can be guided by a number of pairs of oppositely disposed rollers arranged in various combinations, namely brush rollers with smooth rollers or grooved rollers or two brush rollers.

More particularly the brush rollers according to the invention enable coiling stations with and without a coiling core to be formed via which the web of material can be coiled without loss. It is no longer necessary for the start of the web to be cut off and lost. According to the invention such a coiling station is characterized in that a plurality of brush rollers having adjoining stationary guide elements are arranged around a common center, each brush roller being fitted with a plurality of axially spaced-out annular disc-shaped brush elements, between which stationary guide elements extending in the conveying direction of the web of material form a guide cage. In the case of relatively small ribbon lengths, such a coiling station can be without a coiling core. For medium ribbon lengths a coiling core should be provided, which can also consist of a brush roller according to the invention. In that case, however, the brush roller is not equipped with guide elements, since the ribbon is wound around the brush roller. In this coiling station the brush forming the coiling core ensures slip equalization, without the need to provide a slipping clutch, which would otherwise be necessary. The yielding brushes ensure that a number of layers of ribbon can be coiled. Only in the case of greater ribbon lengths must special measures be taken for the reception of the many layers. In a first construction the brush rollers with their guide elements are radially adjustable, while in a second construction they are axially displaceable, since the outer brush rollers must be applied only at the start of coiling on the coiling core.

To enable the coiling rollers to be interchanged, according to another feature of the invention two sets of brush rollers, each disposed around the center and forming a coiling station are disposed parallel with one another, a deflector being disposed upstream thereof.

Figure 2:
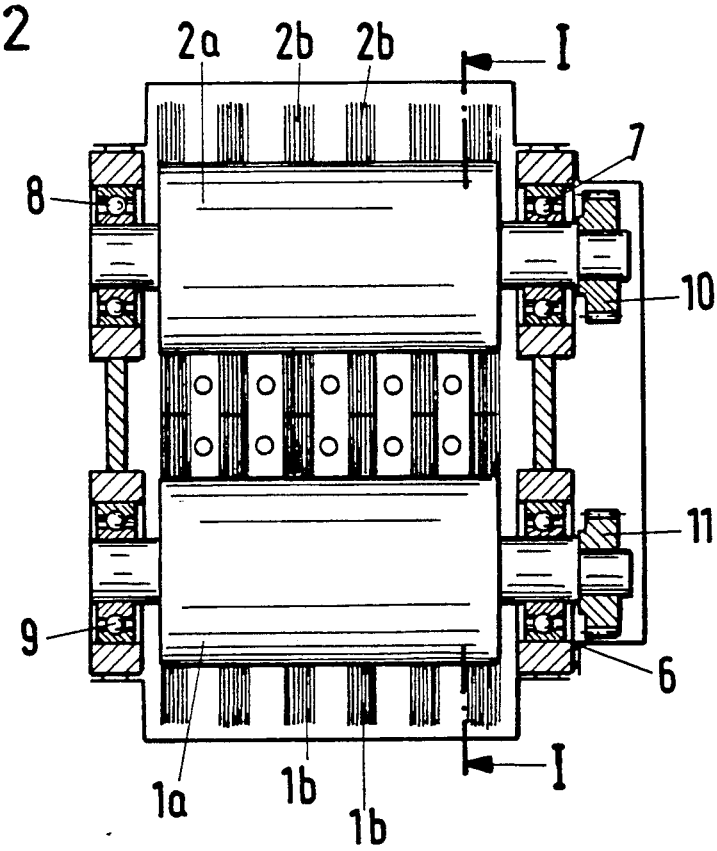
Figure 3:
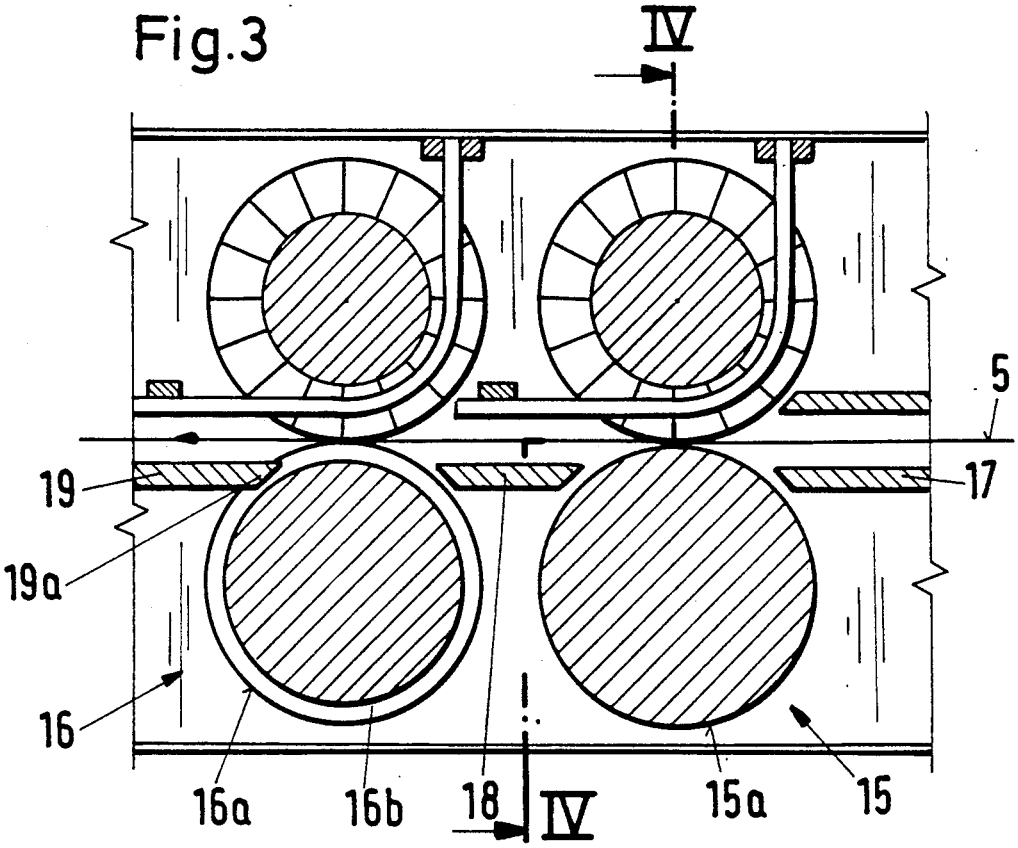
Figure 4:
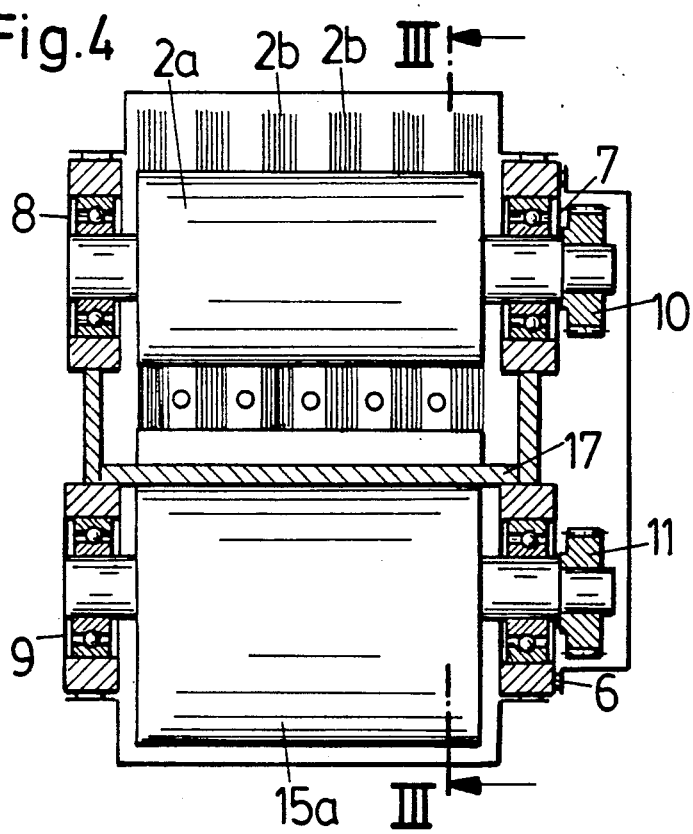
Figure 6:
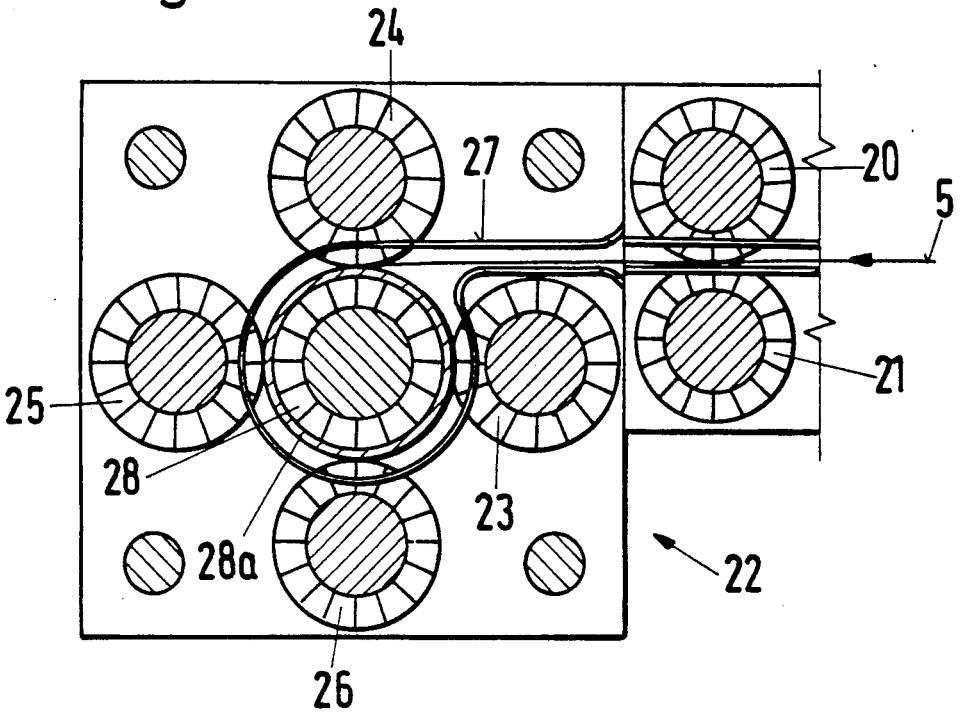
Figure 5:
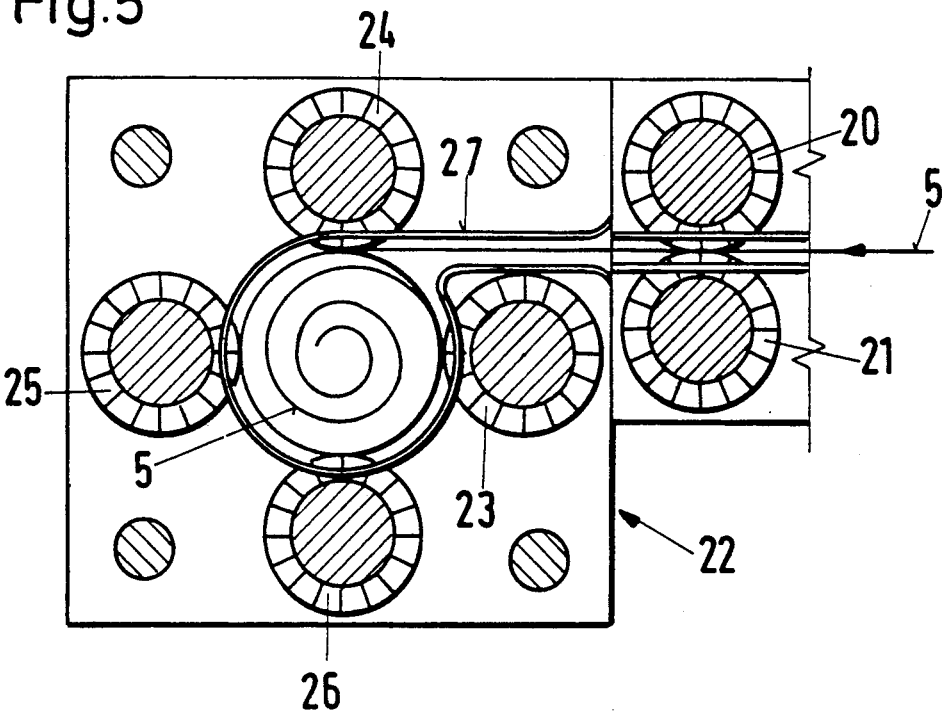
Figure 7:
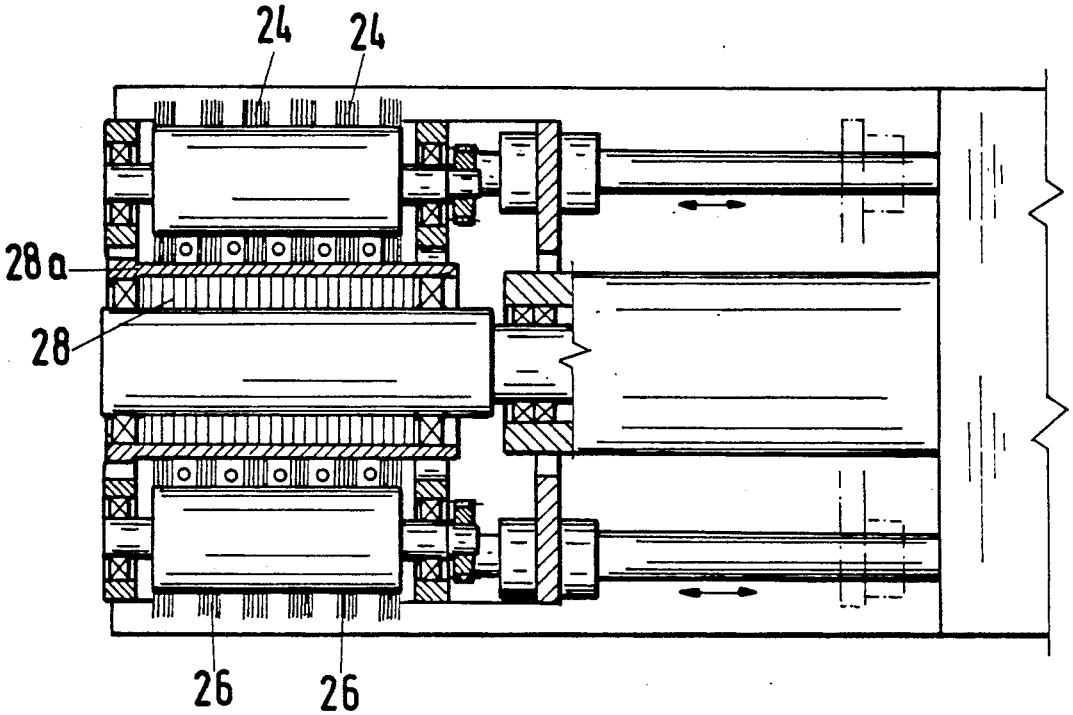
Figure 8:
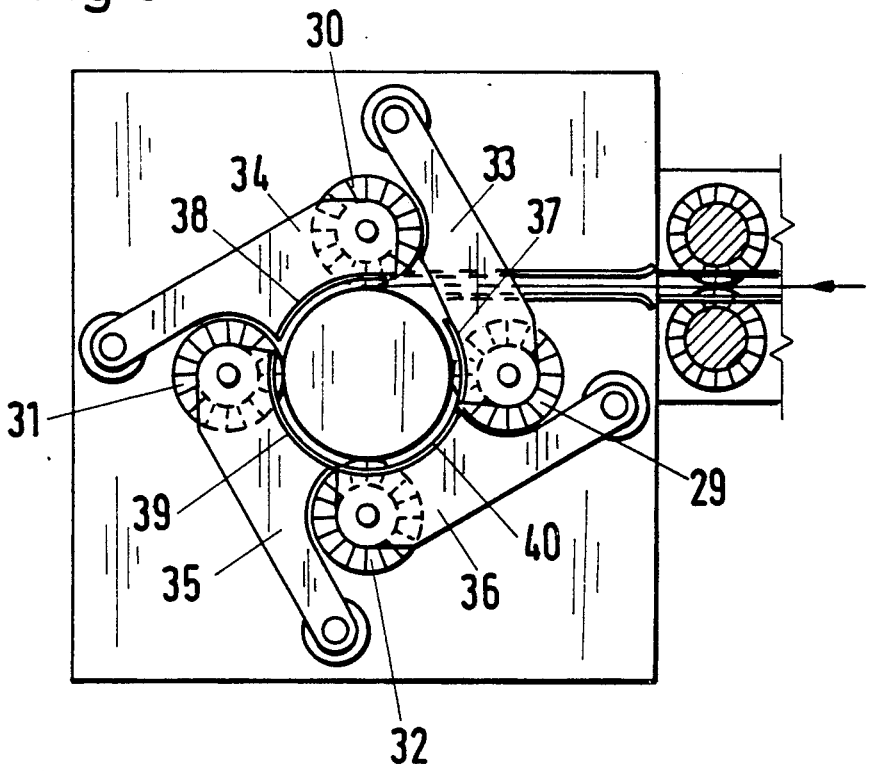
Figure 9:
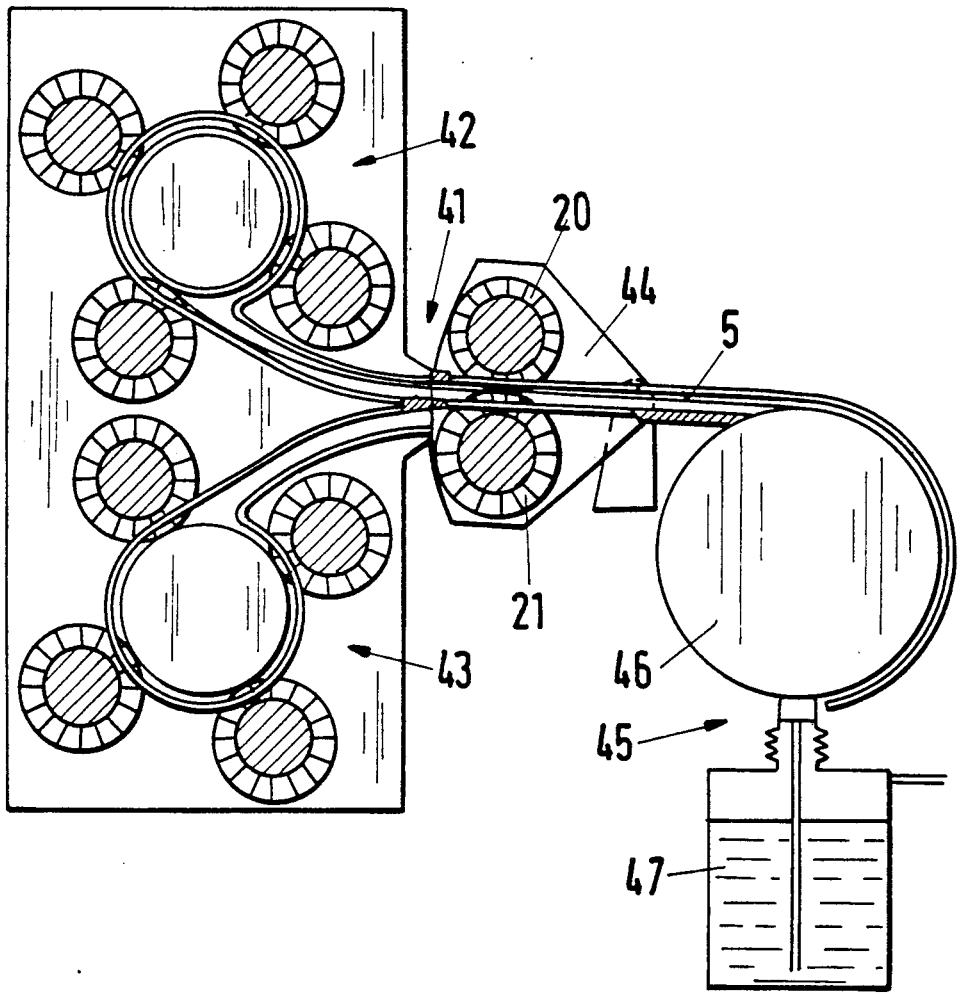

Different embodiments of the invention will now be explained in greater detail with reference to the drawings, wherein:

FIG. 1 shows an apparatus for guiding webs of material in cross-section, taken along the line I-I in FIG. 2, FIG. 2 shows the apparatus illustrated in FIG. 1, axially sectioned along the line II-II in FIG. 1, FIG. 3 shows an apparatus for guiding webs of material in cross-section, taken along the line III-III in FIG. 4, FIG. 4 shows the apparatus illustrated in FIG. 3, axially sectioned along the line IV—IV in FIG. 3, FIG. 5 is a section through a device for the guiding and coreless coiling of webs of material, FIG. 6 is a cross-section through a device for guiding and coiling webs of material on to a core, FIG. 7 shows a device as in FIG. 6 for the coiling of webs of material, axially sectioned along the line V—V in FIG. 6, FIG. 8 is a cross-section through a device for coiling webs of material on to a core, which is a variant of the construction shown in FIG. 7, and FIG. 9 is a cross-section through an apparatus for the alternate coiling of webs of material on to two cores, showing an upstream deflector and an upstream casting machine.

In the apparatus illustrated in FIGS. 1 and 2 two pairs of opposite brush rollers 1–4 are arranged in succession. The brush rollers 1–4 guide between themselves a web of material 5 of sheet thickness arriving from an upstream, for example, ribbon casting machine (not shown). Each brush roller 1–4 comprises a core 1*a*–4*a* and axially spaced-out annular disc-shaped brush elements 1*b*–4*b* disposed thereon. The brush rollers 1–4 are rotatably mounted in lateral bearings 6–9 and driven via gear wheels 10, 11 at a speed which is higher than the speed of the web of material 5. Since the brush elements 1*b*–4*b* clamp the web of material 5 yieldingly, slip occurs between the web 5 and the brush elements 1b–4b, so that the web of material 5 is retained tight but not overloaded.

Extending between the brush elements 1b–4b are rod-shaped stationary guide elements 12–14 which ensure that the start of the web of material does not become wound around one of the brush rollers 1–4, but is fed between the guide elements 12–14 forming a cage to the next brush rollers.

The embodiment illustrated in FIGS. 3 and 4 differs from that shown in FIGS. 1 and 2 only in the substitution for the lower brush roller 1, 4 of a first roller 15 having a smooth generated surface 15a and a second roller 16 having a generated surface 16a formed with annular grooves 16b. Guide elements 17, 18, 19 are provided upstream and downstream of the rollers 15, 16. The guide element 18 takes the form of a plate which closely adjoins the generated surface 15a, while at least the front edge of the guide element 19 is formed with tines 19a which engage in the annular grooves 16b. This also ensures that the web of material 5 cannot become looped around a roller 15, 16.

In the embodiment illustrated in FIGS. 5 and 6 the web of material 5 is fed to a coiling station 22 by brush rollers 20, 21 corresponding to those shown in FIGS. 1 and 2. The coiling station 22 has four brush rollers 23–26 arranged around a center, corresponding to the brush rollers 1–4 in FIGS. 1 and 2. Extending between the brush elements of the brush rollers 23–26 are rod-shaped guide elements 27 forming a circular cage. In the embodiment illustrated in FIG. 5 the center is coreless, while in the embodiment illustrated in FIG. 6 has a driven brush roller 28 corresponding to those shown in FIGS. 1 and 2. Since the brush roller 28 requires no guide elements for preventing winding, it can also be equipped with brush elements continuously over its whole axial length.

While in the embodiment illustrated in FIG. 5 the brush rollers 23–26 arranged around the center cannot be adjusted radially and axially, in the embodiment illustrated in FIG. 6, as shown in axial section in FIG. 7, they can be adjusted axially to the right out of the position shown in the drawing.

The embodiment illustrated in FIG. 8 differs from that shown in FIGS. 6 and 7 by the feature that the brush rollers 29–32 are adjustable not axially, but radially. The brush rollers 29–32 are mounted on pivoting arms 33–36. Associated with each brush roller 32–36 is a guide element 37–40 which is pivoted jointly with the brush roller 29–32.

The axially adjustable brush rollers 23–26 in the embodiment illustrated in FIG. 7 and the radially adjustable brush rollers 29–32 in the embodiment illustrated in FIG. 8 are used to make possible the start of the coiling operation on the brush roller 28 forming the core. After the start of coiling they are removed from the core, so that multilayer coils can be coiled. The embodiment illustrated in FIG. 9 can be put into effect with coiling stations of the embodiments illustrated in FIGS. 6–8. In that case a deflector 41 must be provided between the two superimposed coiling stations 42, 43. For this reason the brush roller 20, 21 disposed upstream of the coiling stations 42, 43 must be retained in a pivotable frame 44. FIG. 9 also shows a casting apparatus 45 (now shown in the other drawings) having a cooling wheel 46 to which molten metal is applied from a tank 47.

We claim:

1. An apparatus for coiling webs of material (5) arriving from a casting wheel (46) of a ribbon casting machine (45), comprising at least one brush roller (2, 3, 20 23-26, 29-32) and a further roller (1, 4, 15, 16, 21, 28) which forces the web of material (5) against the brush roller (2, 3, 20, 23-26, 29-32), the brush roller (2, 3, 20, 23-26) being provided with a plurality of axially spaced-out annular disc-shaped brush elements (1b–4b), and a guide cage including a plurality of stationary guide elements (12, 13, 14, 27, 37–40) which extend in the direction in which the web of material (5) runs, the guide elements extending respectively into the spaces between adjacent brush elements.

2. An apparatus according to claim 1, wherein the further roller (1, 4, 21, 28) takes the form of a brush roller.

3. An apparatus according to claim 1, including stationary guide elements (12) provided on the side of the further roller (1, 4, 21).

4. An apparatus according to claim 1, wherein the guide elements (12, 13, 14, 27, 37–40) are rods.

5. An apparatus for winding webs of material as set forth in claim 1, wherein a plurality of brush rollers (23–26, 29–32) having adjoining stationary guide elements (27, 37–40) are arranged around a common center.

6. An apparatus according to claim 5, including a coiling core (28) disposed in the center.

7. An apparatus according to claim 6, wherein the coiling core (28) is a brush roller.

8. An apparatus according to claim 6, wherein the brush rollers (29-31) with their guide elements (37–40) are radially adjustable.

9. An apparatus according to claim 6, wherein the brush rollers (23–26) with their guide elements (27) are axially adjustable in relation to the coilincore (28).

10. An apparatus according to claim 6, including two parallel sets of brush rollers, each disposed around the center and forming a coiling station (42, 43), the apparatus further including a deflector (41) disposed upstream of the coiling station.

* * * * *